US012595954B2

(12) United States Patent
Han et al.

(10) Patent No.: US 12,595,954 B2
(45) Date of Patent: Apr. 7, 2026

(54) REFRIGERATOR DOOR

(71) Applicant: LG ELECTRONICS INC., Seoul (KR)

(72) Inventors: Sang Chul Han, Seoul (KR); Jin Woo Park, Seoul (KR); Jaeyoon Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 302 days.

(21) Appl. No.: 18/278,065

(22) PCT Filed: Feb. 23, 2022

(86) PCT No.: PCT/KR2022/002659
§ 371 (c)(1),
(2) Date: Oct. 20, 2023

(87) PCT Pub. No.: WO2022/225163
PCT Pub. Date: Oct. 27, 2022

(65) Prior Publication Data

US 2024/0133614 A1 Apr. 25, 2024
US 2024/0230207 A9 Jul. 11, 2024

(30) Foreign Application Priority Data

Apr. 20, 2021 (KR) ..... 10-2021-0051026

(51) Int. Cl.
*F25D 23/02* (2006.01)

(52) U.S. Cl.
CPC ..... *F25D 23/028* (2013.01); *F25D 2327/001* (2013.01); *F25D 2400/18* (2013.01)

(58) Field of Classification Search
CPC ..... F25D 23/028; F25D 2327/001; F25D 2400/18; F25D 23/02; F25D 27/00; F25D 2400/361
USPC ..... 312/405, 405.1, 321.5; 362/92; 62/264
See application file for complete search history.

(56) References Cited

U.S. PATENT DOCUMENTS 8,382,220 B2 * 2/2013 Kim ..... B44C 5/04 312/223.5
8,523,374 B2 9/2013 Pae
2010/0313592 A1 * 12/2010 Pae ..... F25D 23/02 62/449
2010/0327720 A1 * 12/2010 Pae ..... F25D 23/028 49/70

(Continued)

FOREIGN PATENT DOCUMENTS

EP 4310423 A1 * 1/2024 ..... F25D 27/00
JP H05126461 * 5/1993

(Continued)

OTHER PUBLICATIONS

JPH05126461 English translation (Year: 1993).*

(Continued)

*Primary Examiner* — Janet M Wilkens
(74) *Attorney, Agent, or Firm* — KED & ASSOCIATES, LLP

(57) ABSTRACT

A refrigerator door includes a color module which displays various colors by using LEDs. Accordingly, when a consumer desires to change the color of the refrigerator door, the color of the refrigerator door can be changed to color desired by the consumer.

19 Claims, 12 Drawing Sheets

(56) References Cited

U.S. PATENT DOCUMENTS

| | | | | |
|---|---|---|---|---|
| 2018/0160824 | A1 | 6/2018 | Lee | |
| 2018/0164030 | A1 | 6/2018 | Lee | |
| 2019/0383551 | A1 | 12/2019 | Choi et al. | |
| 2023/0194157 | A1 * | 6/2023 | Hong | F25D 29/005 362/92 |

FOREIGN PATENT DOCUMENTS

| | | | | | |
|---|---|---|---|---|---|
| KR | 10-2005-0038391 | | | 4/2005 | |
| KR | 10-2008-0076594 | A | | 8/2008 | |
| KR | 10-2010-0041007 | A | | 4/2010 | |
| KR | 20140102808 | A | * | 8/2014 | F25D 23/08 |
| KR | 20230173566 | A | * | 12/2023 | F25D 23/028 |
| WO | WO-2009093833 | A2 | * | 7/2009 | F25D 23/065 |
| WO | WO 2020060515 | | | 3/2020 | |

OTHER PUBLICATIONS

Extended European Search Report dated Dec. 13, 2024 issued in Application No. 22791865.3.

International Search Report (with English Translation) and Written Opinion dated May 26, 2022 issued in Application No. PCT/KR2022/002659.

* cited by examiner

REFRIGERATOR DOOR

CROSS-REFERENCE TO RELATED PATENT APPLICATIONS

This application is a U.S. National Stage Application under 35 U.S.C. § 371 of PCT Application No. PCT/KR2022/002659, filed Feb. 23, 2022, which claims priority to Korean Patent Application No. 10-2021-0051026, filed Apr. 20, 2021, whose entire disclosures are hereby incorporated by reference.

TECHNICAL FIELD

The present disclosure relates to a new type of refrigerator door which can be changed to a desired color without replacing a front panel.

BACKGROUND ART

In general, a refrigerator is a device that can store stored items located in a storage space for a long period of time while maintaining a predetermined temperature by using cold air.

Such a refrigerator is provided with at least one storage compartment for storing stored items, and the storage compartment is configured to be opened and closed by a door. In this case, the door may include at least one of a swinging door and a drawer-type door.

Meanwhile, recently, a consumer is making many demands not only on the function of the product but also on the appearance of the product. That is, it is intended to form the exterior of a product with a design or color that matches living space.

Accordingly, various prior arts are disclosed in Korean Patent Application Publication No. 10-2007-0003397 (Patent Document 1), Korean Patent Application Publication No. 10-2013-0135485 (Patent Document 2), and Korean Patent Application Publication No. 10-2014-0102808 (Patent Document 3).

Here, in the case of the prior art disclosed in Patent Document 1, a decorative panel formed of a pair of glass panels is provided on a front surface of a refrigerator door, and decorative materials such as dye-mixed water are injected into a hollow part of the decorative panel to form the exterior of the refrigerator door.

In the case of the prior art disclosed in Patent Document 2, a decorative panel is provided on the outer surface of a refrigerator door, and dirt may be prevented from being introduced into a gap between an outer door and the decorative panel.

In the case of the prior art disclosed in Patent Document 3, a rear panel having specific color is disposed on the rear of a metal panel having multiple holes to change design of a refrigerator door such that a user can recognize the changed design.

However, in the prior arts disclosed in Patent Documents 1, 2, and 3 described above, the decorative panel installed on the front surface of the refrigerator door is configured to be fixed to the door, and particularly, is required to be precisely installed thereon to remove various gaps, so the overall installation structure of the door is complicated and installation work thereof is also difficult.

In addition, according to the prior arts disclosed in Patent Documents 1, 2, and 3, only a uniform color or design is provided, so when design or environment in a home at which the associated refrigerator is installed is changed, it is difficult to adapt to the changing design or environment.

Of course, as in a prior art disclosed in Korean Patent Application Publication No. 10-2005-0104119 (Patent Document 4), a separate decorative plate can be attached to and detached from the outer surface of a refrigerator door such that the problems of the prior arts disclosed in Patent Documents 1, 2, and 3 described above can be solved.

However, in the case of the prior art disclosed in Patent Document 4 described above, a work for attaching and detaching the decorative plate is not easy for a general consumer.

That is, in a process in which a consumer attaches and detaches the decorative plate, coupling parts may be damaged, and thus it is required to request a professional worker for the attaching and detaching work.

Furthermore, according to the prior art disclosed in Patent Document 4 described above, the separate decorative plate is coupled to the outer surface of the refrigerator door, so the entire thickness of the refrigerator door is unavoidably increased.

In addition, in the case of each of the prior arts disclosed in Patent Documents described above, the color of the decorative plate is limited only to color decided by a manufacturer, so there is a limit to applying color desired by a consumer. That is, the selection of color of the decorative plate that can match or harmonize with the color of a kitchen wall or surrounding furniture or devices is limited, and when purchasing a new home appliance (for example, an air conditioner, dryer, or air purifier, etc.), it is difficult to harmonize color thereof with the color of the decorative plate.

DISCLOSURE

Technical Problem

The present disclosure has been made to solve various problems occurring in the related art described above, and the present disclosure is intended to propose a refrigerator door whose surface color can be changed to a desired color without replacing a front panel.

In addition, the present disclosure is intended to propose a refrigerator door whose surface color can be easily changed.

Furthermore, the present disclosure is intended to propose a refrigerator door in which increase in the thickness of the refrigerator door can be minimized and the installation state of the front panel located on the surface of the refrigerator door can be stably maintained.

Technical Solution

In order to achieve the above objectives, according to a refrigerator door of the present disclosure, a door frame may be provided with a color module having multiple LEDs on a front surface thereof such that the color of the refrigerator door desired by a user is embodied.

According to the refrigerator door of the present disclosure, two protruding ends may be formed on the peripheries of the opposite sides of the front surface of the door frame by protruding forward.

According to the refrigerator door of the present disclosure, the color module having multiple LEDs may be mounted between the two protruding ends protruding to the front side of the door frame.

According to the refrigerator door of the present disclosure, a support part supporting the rear surface of the color module may be formed on the front surface of the door frame.

According to the refrigerator door of the present disclosure, the support part may include a plurality of support parts.

According to the refrigerator door of the present disclosure, the plurality of support parts may be formed on the front surface of the door frame by being spaced apart from each other in a transverse or longitudinal direction of the door frame.

According to the refrigerator door of the present disclosure, the plurality of support parts may be formed by transforming the front surface of the door frame.

According to the refrigerator door of the present disclosure, the plurality of support parts may be formed by being attached to the front surface of the door frame.

According to the refrigerator door of the present disclosure, partitioning protrusions may be respectively on the opposing surfaces of the two protruding ends by protruding therefrom.

According to the refrigerator door of the present disclosure, the partitioning protrusions may be respectively configured to cover the opposite edges of the front surface of the color module.

According to the refrigerator door of the present disclosure, a tempered glass may be provided on the front of the color module.

According to the refrigerator door of the present disclosure, the tempered glass may be fitted and fastened between the opposing surfaces of the two protruding ends.

According to the refrigerator door of the present disclosure, the partitioning protrusions may be formed respectively on the opposing surfaces of the two protruding ends.

According to the refrigerator door of the present disclosure, the partitioning protrusions may be configured to be located between the tempered glass and the color module and to partition the peripheries of the opposite sides thereof.

According to the refrigerator door of the present disclosure, the tempered glass and the color module may be attached to each other by using an adhesive member.

According to the refrigerator door of the present disclosure, the adhesive member may be provided on at least one edge of the tempered glass and the color module.

According to the refrigerator door of the present disclosure, first mounting grooves may be formed to face each other on the opposing surfaces of an upper cover frame and a lower cover frame, respectively.

According to the refrigerator door of the present disclosure, the first mounting grooves may be respectively configured to receive the upper and lower ends of the door frame.

According to the refrigerator door of the present disclosure, second mounting grooves may be formed to face each other on opposing surfaces of the upper cover frame and the lower cover frame, respectively.

According to the refrigerator door of the present disclosure, the second mounting grooves may be respectively configured to receive the upper and lower ends of the color module.

According to the refrigerator door of the present disclosure, glass receiving parts may be formed in the upper cover frame and the lower cover frame, respectively.

According to the refrigerator door of the present disclosure, each of the glass receiving parts may be formed by protruding more forward from each of the second mounting grooves.

According to the refrigerator door of the present disclosure, the tempered glass may be received in the glass receiving parts.

According to the refrigerator door of the present disclosure, the color module may include a light guide plate and an LED board.

According to the refrigerator door of the present disclosure, the LED board may be located on at least one periphery of the light guide plate.

According to the refrigerator door of the present disclosure, multiple LEDs may be mounted on the surface of the LED board facing the light guide plate.

According to the refrigerator door of the present disclosure, the color module may include a diffusing plate located on the front surface of the light guide plate.

According to the refrigerator door of the present disclosure, the LED board may be received in any one cover frame of the upper cover frame and the lower cover frame.

According to the refrigerator door of the present disclosure, a cover protrusion may be formed on a cover frame in which the LED board is received.

According to the refrigerator door of the present disclosure, the cover protrusion may be configured to cover the installation portion of the LED board such that the installation portion is not exposed to the front surface of the refrigerator door.

According to the refrigerator door of the present disclosure, the cover protrusion may be configured to have enough length to cover the periphery of the light guide plate.

According to the refrigerator door of the present disclosure, the LED board may be received inside any one protruding end of the two protruding ends.

According to the refrigerator door of the present disclosure, a partitioning protrusion may be formed on a protruding end in which the LED board is received.

According to the refrigerator door of the present disclosure, a connector for cable connection may be provided on any one side of the LED board.

According to the refrigerator door of the present disclosure, the connector of the LED board may be installed to be exposed to the outside of the cover frame or the protruding end.

Advantageous Effects

As described above, the refrigerator door of the present disclosure may have the following effects.

The refrigerator door of the present disclosure may be expressed in color desired by a user by using multiple LEDs, thereby facilitating color change of the door.

In the refrigerator door of the present disclosure, color of the door may be changed by manipulation by a user, thereby expressing the refrigerator door (or a front surface thereof) in color desired by a user even without replacing the entirety of the refrigerator door or the front surface of the refrigerator door.

In the refrigerator door of the present disclosure, a structure for the installation of the color module may be configured to be integrated with the front surface of the refrigerator door, thereby preventing problems such as the inconvenience of assembly of the refrigerator door and the increase of the thickness of the refrigerator door due to the increase of the number of structures.

In the refrigerator door of the present disclosure, the LED board may be configured to be located in the cover frame and to be covered by the cover protrusion, thereby preventing light leakage.

In the refrigerator door of the present disclosure, the tempered glass may be configured to be received in the glass receiving parts and be attached to the partitioning protrusions or the front surface of the color module, thereby minimizing the thickness of the refrigerator door and facilitating the installation work of the tempered glass.

In the refrigerator door of the present disclosure, the plurality of support parts may be formed on the front surface of the door frame to support the light guide plate such that the light guide plate has a precisely flat surface, thereby preventing color defects due to bending deformation of the light guide plate.

MODE FOR INVENTION

Hereinafter, an exemplary embodiment of a refrigerator door of the present disclosure will be described with reference to FIGS. 1 to 13.

Prior to the description of the embodiment, description regarding direction for each position of each component may be based on a state in which a refrigerator is installed for use. That is, in a state of transporting, assembling, or storing the refrigerator, such as laying down or turning over the refrigerator, direction for each position of each component of the refrigerator may be differently described.

Figure 1:
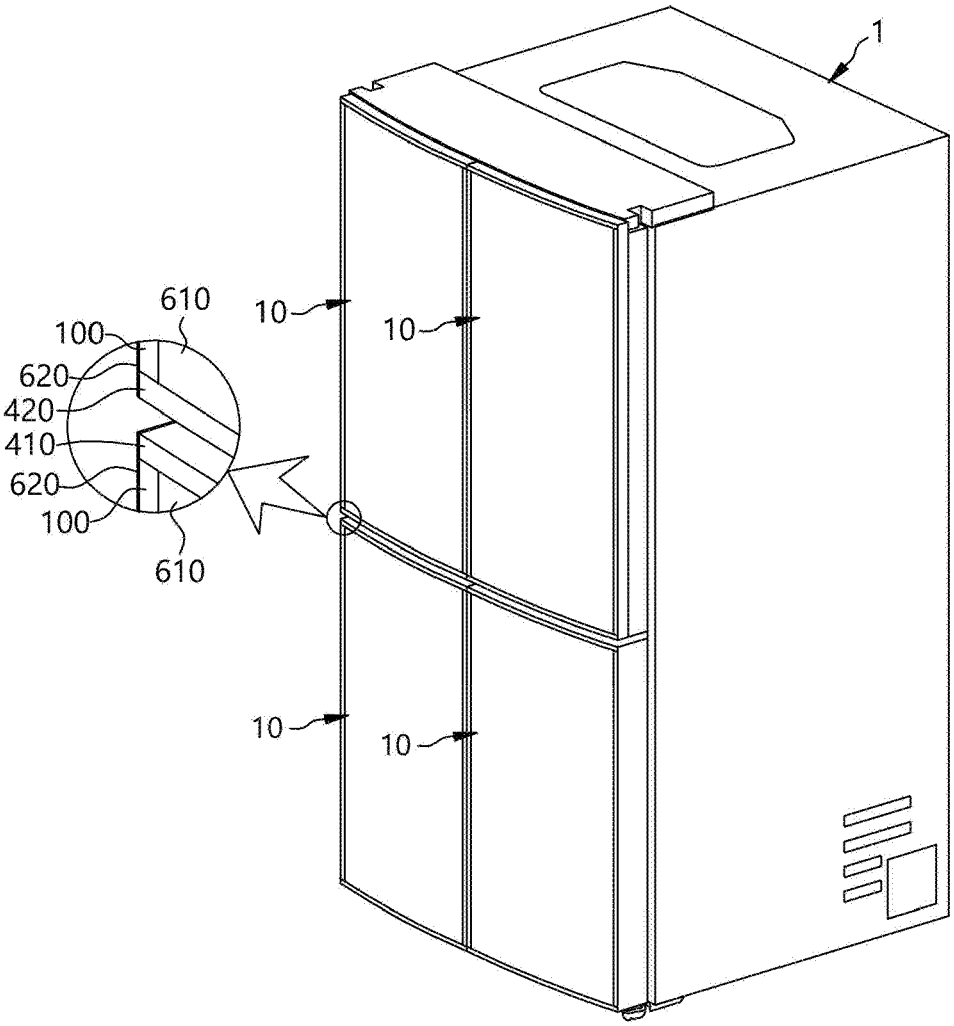
FIG. 1 is a perspective view illustrating an example of a refrigerator to which a refrigerator door according to an embodiment of the present disclosure is applied.
Figure 2:
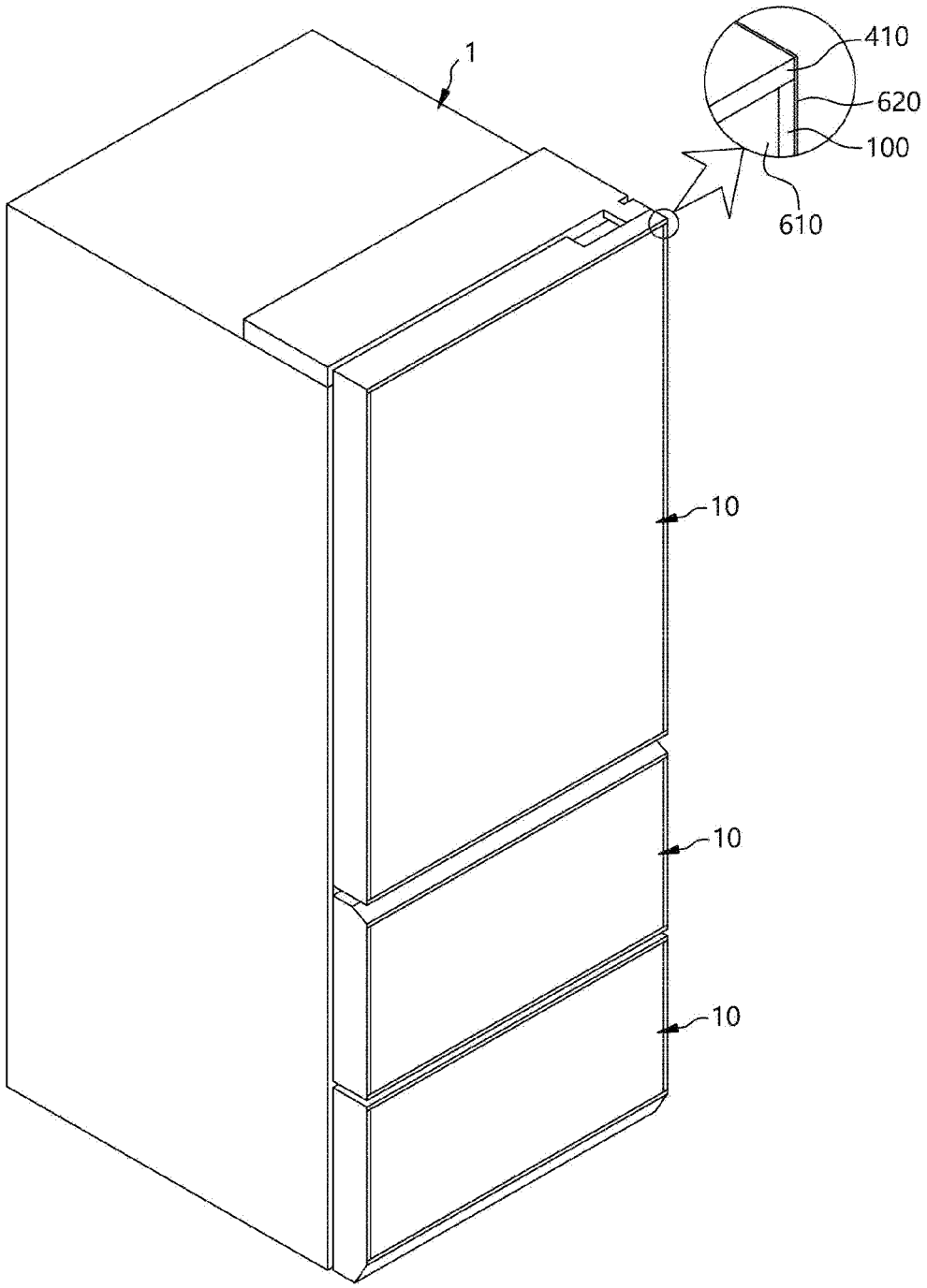
FIG. 2 is a perspective view illustrating a different example of the refrigerator to which the refrigerator door according to the embodiment of the present disclosure is applied.

Each of FIGS. 1 and 2 illustrates the exterior of a refrigerator having the refrigerator door of the present disclosure installed thereon.

According to these exteriors, the refrigerator door 10 of the present disclosure, which is a door which opens and closes a storage compartment (not shown) formed in a refrigerator body 1, may be a swinging door provided on the refrigerator of FIG. 1, or may be at least one door of the swinging door and a drawer-type door provided on a refrigerator of FIG. 2.

Figure 3:
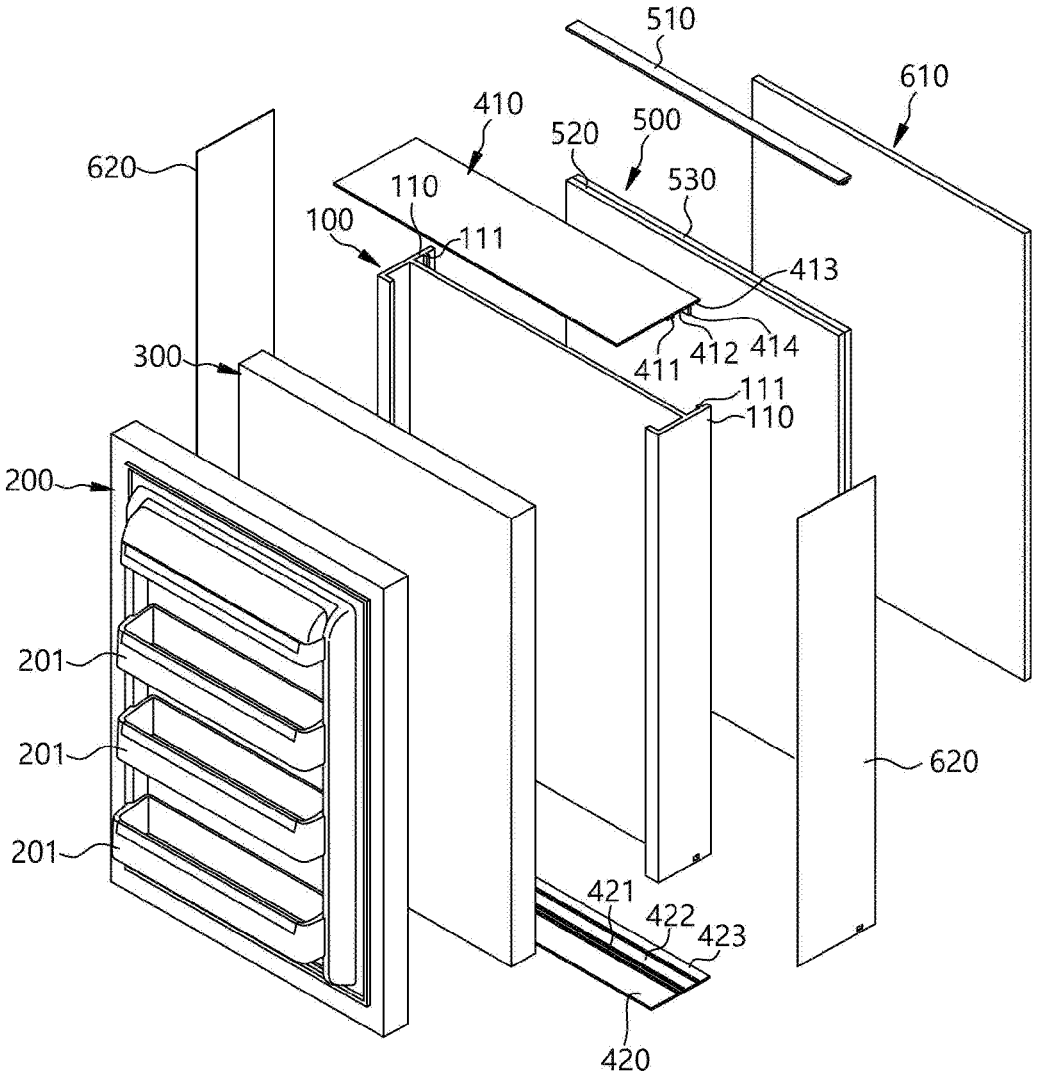
FIG. 3 is an exploded perspective view of the refrigerator door according to the embodiment of the present disclosure.
Figure 4:
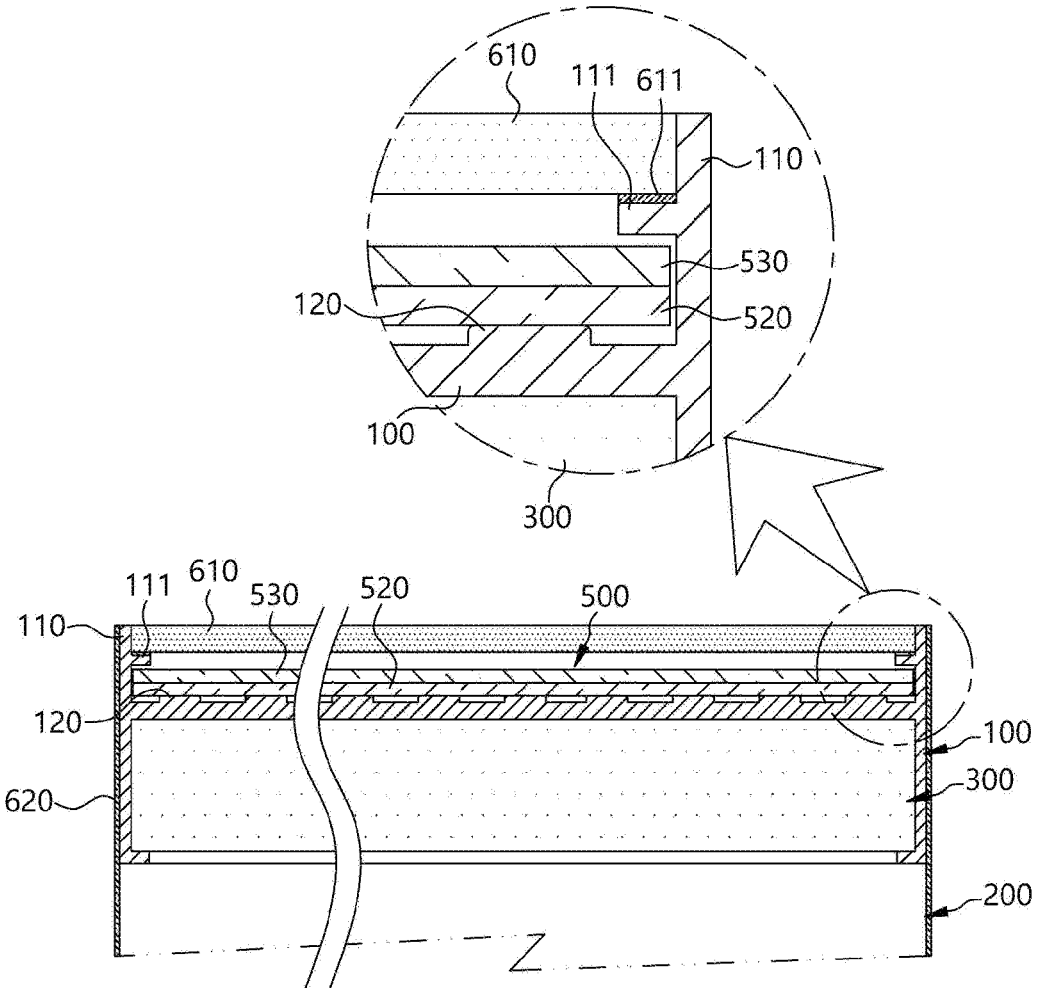
FIG. 4 is a cross sectional view of the refrigerator door when viewed from a top thereof according to the embodiment of the present disclosure.
Figure 5:
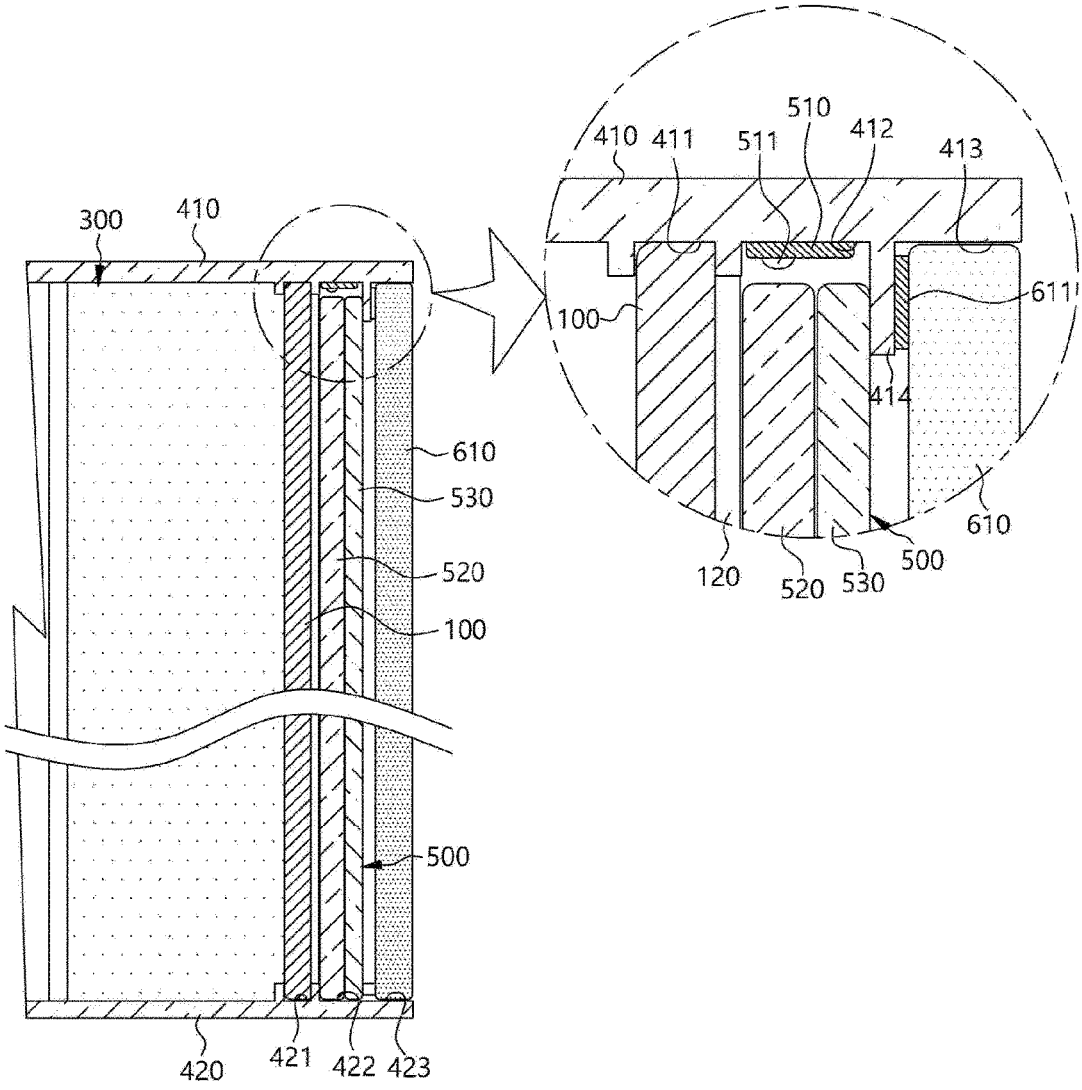
FIG. 5 is a sectional view of the refrigerator door when viewed from a side thereof according to the embodiment of the present disclosure.

FIGS. 3 to 5 illustrate the refrigerator door 10 according to the embodiment of the present disclosure.

That is, the refrigerator door 10 according to the embodiment of the present disclosure may include a color module 500 configured to display color of the refrigerator door by using LEDs. Accordingly, the color of the refrigerator door 10 may be changed to a color desired by a consumer when the consumer desires a particular color Hereinafter, each component of the refrigerator door 10 according to the embodiment of the present disclosure will be described in more detail.

First, the refrigerator door 10 according to the embodiment of the present disclosure may include a door frame 100.

The door frame 100 may be configured as the outer body of the refrigerator door 10. That is, the door frame 100 may constitute the front wall surface of the refrigerator door 10.

The door frame 100 may be formed of a metal plate, or may be formed of an injection molded product of synthetic resin.

Protruding ends 110 may be formed on the door frame 100 by protruding forward therefrom. For example, the protruding ends 110 may be formed respectively on one side and the remaining one side of the peripheries of the front surface of the door frame 100. In this case, each of the protruding ends 110 may be formed to be integrated with the front surface of the door frame 100 or may be manufactured separately from the door frame 100 so as to be attached, fused, contacted, or combined with the front surface of the door frame 100.

The front surfaces of the two protruding ends 110 may be configured respectively as the front edges of the opposite sides of the refrigerator door 10. That is, when the refrigerator door 10 is viewed from the front side, the front surfaces of the two protruding ends 110 may constitute the front edges of the refrigerator door 10.

The door frame 100 may be formed of various materials. For example, the door frame 100 may be formed of a metal plate. In this case, the protruding end 110 may be formed by bending the opposite ends of the door frame 100 forward.

For example, the door frame 100 may be formed of synthetic resin. In this case, the protruding ends 110 may be configured as integral structures formed by protruding forward respectively from the opposite edges of the front surface of the door frame 100.

In addition, as illustrated in FIG. 4, a partitioning protrusion 111 may be formed on the inner surface of each of the two protruding ends 110. The partitioning protrusion 111 may be a structure for installing the color module 500 to be described later, and the color module 500 may be located between the partitioning protrusions 111 and the front surface of the door frame 100.

In this case, the partitioning protrusion 111 may be configured to protrude by having such a length (height) that the color module 500 is not removed forward unintentionally. That is, the partitioning protrusion 111 may be configured to cover the opposite edges of the front surface of the color module 500. Accordingly, the color module 500 may be removed from or coupled to the door frame 100 in a vertical direction.

The partitioning protrusion 111 may be configured to be located by being spaced apart from an end of each of the two protruding ends 110. In this case, a distance by which partitioning protrusion 111 is spaced apart from the end of the protruding end may be the thickness of the tempered glass 610. That is, a seating portion in which the tempered glass 610 can be installed may be provided on the front of the partitioning protrusion 111 between the two protruding ends 110.

Next, the refrigerator door 10 according to the embodiment of the present disclosure may include an inner frame 200 (see FIG. 3).

The inner frame 200 may be configured as the inner body of the refrigerator door 10. That is, the inner frame 200 may constitute the rear wall surface of the refrigerator door 10.

A storage box 201 may be installed on the wall surface of such an inner frame 200 located at the inside of the refrigerator.

In addition, the inner frame 200 may be located to be spaced apart from the door frame 100. That is, space may be defined between the inner frame 200 and the door frame 100 such that an insulation member 300 to be described later fills the space.

Next, the refrigerator door 10 according to the embodiment of the present disclosure may include the insulation member 300 (see FIGS. 3 to 5).

The insulation member 300 may be provided to prevent heat exchange between room temperature and the internal temperature of the refrigerator.

The insulation member 300 may be provided between the door frame 100 and the inner frame 200, and accordingly, heat exchange between the door frame 100 and the inner frame 200 may be prevented.

The insulation member 300 may be configured as foam (for example, PU foam). In this case, in a state in which the door frame 100 and the inner frame 200 are provided, the foam may be filled between the two frames 100 and 200 so as to form the insulation member 300.

Of course, although not shown, the insulation member 300 may be configured as a separate member from each of the frames 100 and 200 and may be located between the two frames 100 and 200 to be coupled or attached to the two frames 100 and 200, or may be omitted.

Meanwhile, the opposite sides of the door frame 100 and the inner frame 200 may be configured to be covered by side wall frames 620, respectively. That is, the side wall frames 620 may respectively constitute the opposite wall surfaces of the refrigerator door 10, and accordingly, the door frame 100 and the inner frame 200 may be maintained to be spaced apart by a predetermined distance from each other, and a foam may be filled between the door frame 100 and the inner frame 200 so as to form the insulation member 300.

In this case, each of the side wall frames 620 may be provided separately from the door frame 100 or the inner frame 200 and may be configured to simultaneously cover the two frames 100 and 200. Of course, although not shown, the side wall frame 620 may be configured to completely cover any one frame of the two frames 100 and 200 and to cover only at least a portion of the remaining one frame, or may be configured to cover only a portion of each of the two frames 100 and 200.

Such a side wall frame 620 may be formed of a thin metal plate or a synthetic resin.

Of course, the side wall frame 620 may be omitted, and the opposite ends of at least any one frame of the door frame 100 and the inner frame 200 may be respectively bent to cover the side surfaces of the remaining frame.

Next, the refrigerator door 10 according to the embodiment of the present disclosure may include cover frames 410 and 420.

The cover frames 410 and 420 may include the upper cover frame 410 for constituting an upper wall surface of the refrigerator door 10. In this case, the upper cover frame 410 may be configured to cover the upper end of each of the door frame 100 and the inner frame 200 and may be provided as the upper wall surface of the refrigerator door 10.

The cover frames 410 and 420 may include the lower cover frame 420 for constituting a lower wall surface of the refrigerator door 10. In this case, the lower cover frame 420 may be configured to cover the lower end of each of the door frame 100 and the inner frame 200 and may be provided as the lower wall surface of the refrigerator door 10.

Both of the upper cover frame 410 and the lower cover frame 420 may be provided simultaneously. Although not shown, only one of the upper cover frame 410 and the lower cover frame 420 may be provided.

As illustrated in FIGS. 3 and 5, the first mounting grooves 411 and 421 may be formed to face each other in the cover frames 410 and 420, respectively, so as to install the door frame 100. That is, the upper and lower ends of the door frame 100 may be received in the first mounting grooves 411 and 421, respectively, and may be maintained to be coupled to the two cover frames 410 and 420, respectively.

In this case, the first mounting grooves 411 and 421 may be formed in the cover frames 410 and 420, respectively, by being recessed therefrom, or two protrusions spaced apart from each other may be formed on each of the cover frames 410 and 420 by protruding therefrom such that furrows defined between the two protrusions constitute the first mounting grooves 411 and 421.

In addition, second mounting grooves 412 and 422 for the installation of the color module 500 may be formed to face each other in the cover frames 410 and 420, respectively. That is, the upper and lower ends of the color module 500 may be received in the second mounting grooves 412 and 422, respectively, and may be maintained to be coupled to the two cover frames 410 and 420, respectively.

In this case, the second mounting grooves 412 and 422 may be configured to be located in front of the first mounting grooves 411 and 421, respectively. Accordingly, the color module 500 may be located on the front surface of the door frame 100.

The second mounting grooves 412 and 422 may be formed in the cover frames 410 and 420, respectively, by being recessed therefrom or may be formed by protrusions formed to be lower than protrusions for forming the first mounting grooves 411 and 421. Of course, separate protrusions may be additionally formed to form the second mounting grooves 412 and 422.

In addition, as illustrated in FIGS. 3 and 5, the glass receiving parts 413 and 423 for installing the tempered glass 610 may be formed to face each other in the cover frames 410 and 420, respectively.

Such glass receiving parts 413 and 423 may be formed by protruding forward from the second mounting grooves 412 and 422, respectively such that the tempered glass 610 can be received in portions of the front sides of the second mounting grooves 412 and 422 formed in the cover frames 410 and 420. The tempered glass 610 may function to protect the color module 500 installed on the front surface of the door frame 100 located inside the cover frames 410 and 420 from an external environment.

In this case, the front surfaces of the glass receiving parts 413 and 423 may be configured respectively as the upper and lower front edges of the refrigerator door 10. That is, the glass receiving parts 413 and 423 and the front surfaces of the two protruding ends 110 may constitute the front edges of the refrigerator door 10.

Meanwhile, the cover frames 410 and 420 and the side wall frames 620 are preferably formed of opaque materials through which light does not pass. That is, light supplied from the color module 500 to be described later may not pass through the cover frames 410 and 420 and the side wall frame 620, but may emit only forward.

Next, the refrigerator door 10 according to the embodiment of the present disclosure may include the color module 500.

The color module 500 may be an LED module that displays a color desired by a user. Such a color module 500 may be provided on the front surface of the door frame 100.

That is, in the embodiment of the present disclosure, rather than changing the color of the surface of the refrigerator door by replacing the color module 500, the color of the surface of the refrigerator door 10 may be changed by controlling color expressed in the color module 500 through a controller (not shown) or a mobile app. Accordingly, the inconvenience of a prior art in which when changing the color of the front surface of the refrigerator door 10, the refrigerator door 10 having the color or the front surface thereof (for example, a decorative panel) is required to be replaced may be released.

The color module 500 may include an LED board 510 constituting a light source, and a light guide plate 520 which evenly spreads light provided from the light source (the LED board) over an entire screen thereof.

Here, the LED board 510 may be configured as a substrate configured such that multiple RGB LEDs 511 are mounted on the surface of the substrate.

In addition, the LED board 510 may be located on any one portion around the light guide plate 520. Specifically, the LED board 510 may be located on any one portion of the upper and lower sides of the light guide plate 520.

For example, as illustrated in FIG. 5, the LED board 510 may be located inside the upper cover frame 410, and the multiple LEDs 511 mounted on the LED board 510 may be configured to be located on the upper side of the light guide plate 520 such that the multiple LEDs 511 emit light toward the light guide plate 520.

Figure 6:
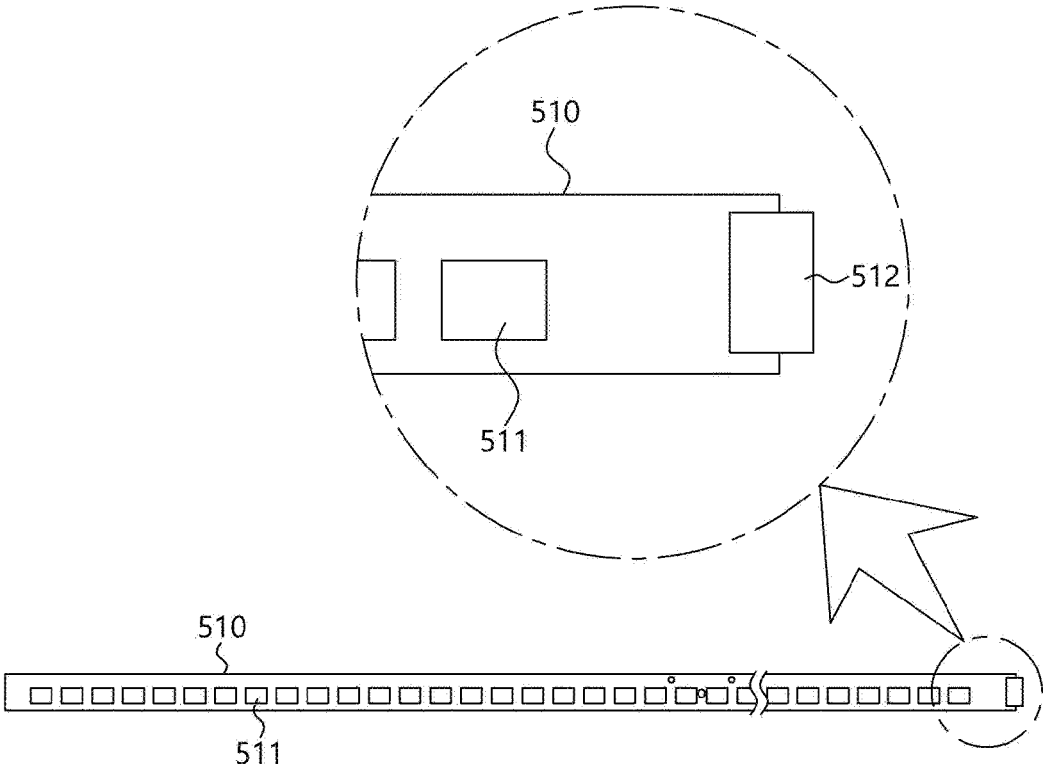
FIG. 6 is a top plan view illustrating an LED board of the refrigerator door according to the embodiment of the present disclosure.
Figure 7:
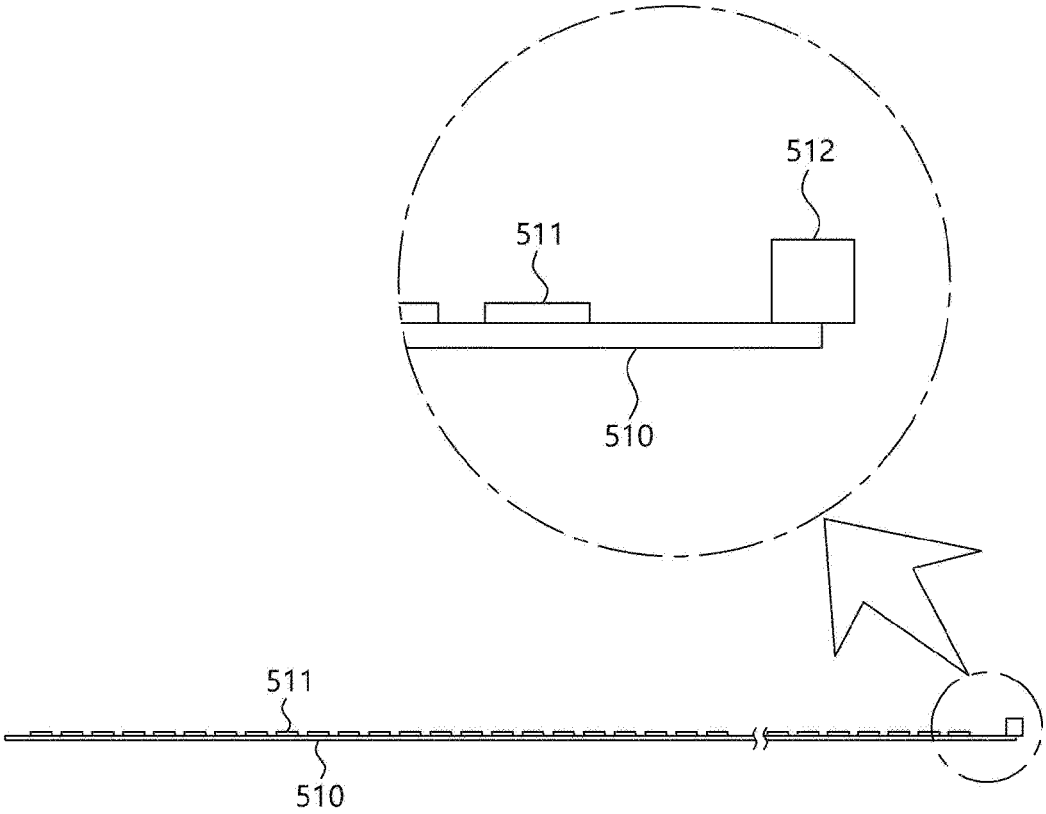
FIG. 7 is a front view illustrating the LED board of the refrigerator door according to the embodiment of the present disclosure.
Figure 8:
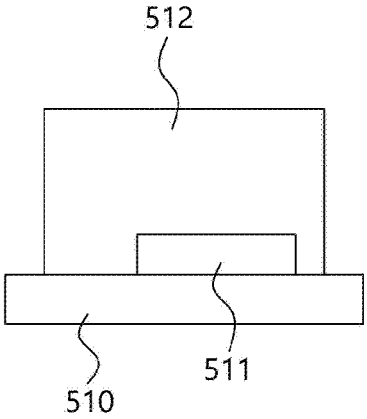
FIG. 8 is a side view illustrating the LED board of the refrigerator door according to the embodiment of the present disclosure.

In addition, as illustrated in FIGS. 6 to 8, the connector 512 may be formed on any one side of the LED board 510. In this case, a cable (not shown) for the luminescence control of each of the LEDs 511 mounted on the LED board 510 and power supply thereto may be connected to the connector 512.

Particularly, the connector 512 may be configured to be exposed through the side wall frame 620 to the outside, and thus the operation control of the LED board 510 may be performed by the controller of the refrigerator.

Meanwhile, a cover protrusion 414 (see FIG. 5) may be formed in front of the second mounting groove 412 of the upper cover frame 410 receiving the LED board 510.

The cover protrusion 414 may be configured to prevent the installation portion of the LED board 510 from being exposed to the front surface of the refrigerator door. Although not shown, when the LED board 510 is located at the lower cover frame 420, the cover protrusion 414 may be formed in front of the second mounting groove 422 of the lower cover frame.

Particularly, the cover protrusion 414 may be formed to have enough length to cover a periphery of the light guide plate 520. That is, the cover protrusion 414 may be configured to have enough length to cover the opposing portions of the peripheral surface of the light guide plate 520 and the LED 511. Accordingly, the cover protrusion 414 may cover a portion of each of the LEDs 511 mounted on the LED board 510 from which light begins to be emitted, so light leakage may be prevented.

Of course, the cover protrusion 414 is preferably configured to have length in consideration of the light leakage and a color display area as wide as possible.

In addition, the light guide plate 520 and a diffusing plate 530 may be provided in the second mounting grooves 412 and 422. That is, light guided by the light guide plate 520 may be diffused more widely through the diffusing plate 530. Of course, the light guide plate 520 and the diffusing plate 530 may be formed as a single body.

Although not shown, hinges (not shown) may be installed on the upper cover frame 410 and the lower cover frame 420, respectively. The hinges are components which couple the associated refrigerator door 10 rotatably to the refrigerator body.

Meanwhile, the support part 120 which supports the rear surface of the light guide plate 520 may be formed on the front surface of the door frame 100.

That is, since the light guide plate 520 is formed of a plate material, the light guide plate 520 may be easily bent and deformed, so display defects may occur due to refraction of light. In consideration of this, the support part 120 may be used such that the light guide plate 520 has a precisely flat surface.

The support part 120 may be formed partially on the front surface of the door frame 100. That is, the support part 120 may include a plurality of support parts. The plurality of support parts 120 may be formed on the front surface of the door frame 100 by being spaced apart from each other in a transverse or longitudinal direction of the door frame 100.

Particularly, the support part 120 described above may be formed by protruding a portion of the front surface of the door frame 100 forward. When the door frame 100 is formed of a metal plate, a portion of the door frame 100 may be punched and bent to form the support part 120.

Although not shown, the support part 120 may be formed separately from the door frame 100 and then attached to or coupled to the front surface of the door frame 100 so as to be integrated therewith.

In addition, the tempered glass 610 may be located in the glass receiving parts 413 and 423 of the cover frames 410 and 420 located in front of the cover protrusion 414.

The tempered glass 610 is a cover which protects the color module 500 from an external environment.

The tempered glass 610 may be formed of transparent glass or colored glass. Of course, the tempered glass 610 may be formed of a light-passable synthetic resin (a transparent synthetic resin or a colored synthetic resin).

The tempered glass 610 may be attached to and fixed to the front surface of the color module 500 by the adhesive member 611 (see FIG. 5). Although not shown, the coupling of the tempered glass 610 may be performed by a separate fastening member (for example, screws, etc.), or the opposing surfaces of the peripheral surface of the tempered glass 610 and the inner surface of the upper cover frame 410 may be glued to each other to be fastened to each other. Although not shown, the ends of the upper cover frame 410 may be additionally bent to prevent the removal of the tempered glass 610 therefrom.

The adhesive member 611 may be provided on the opposing wall surfaces of the tempered glass 610 and the color module 500. For example, as illustrated in FIG. 4, the adhesive member 611 may be provided on the opposing surfaces of the partitioning protrusion 111 and the tempered glass 610, and as illustrated in FIG. 5, may be provided on the opposing surfaces of the cover protrusion 414 and the tempered glass 610.

Hereinafter, the manufacturing process of the refrigerator door 10 according to the embodiment of the present disclosure described above will be described with reference to FIGS. 9 to 13.

Figure 9:
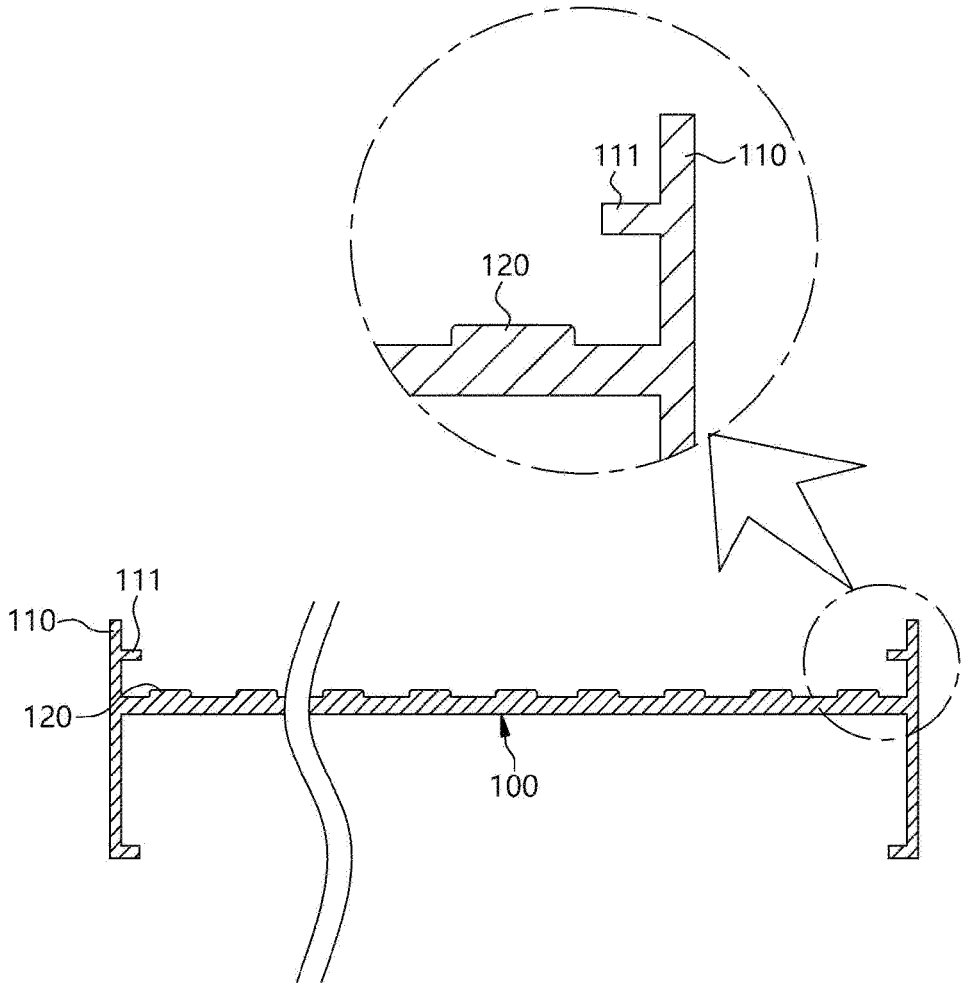
FIGS. 9 to 13 are views illustrating the sequential manufacturing process of the refrigerator door according to the embodiment of the present disclosure when viewed in each direction.
Figure 10:
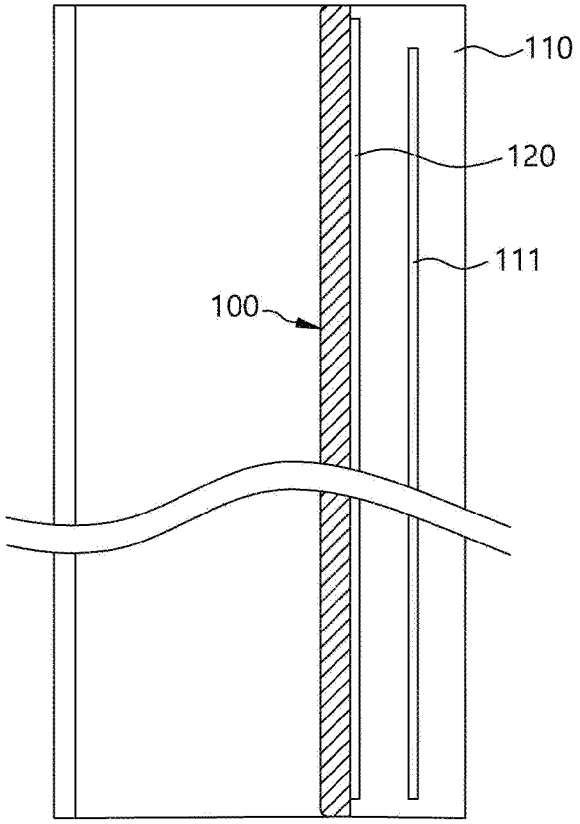

First, as illustrated in FIGS. 9 and 10, the door frame 100 is prepared.

The door frame 100 described above may be manufactured through a press process or may be manufactured through an injection process. For example, when the door frame 100 is formed of metal, the door frame 100 may be manufactured through the press process, and when the door frame 100 is formed of synthetic resin, the door frame 100 may be manufactured through the injection process. Of course, when the door frame 100 is formed by mixing metal with synthetic resin, the door frame 100 may be manufactured by a double injection process after the press process.

Next, the color module 500 is prepared.

The color module 500 may be provided such that the light guide plate 520, the diffusing plate 530, and the LED board 510 have structure separate from each other. Of course, although not shown, the light guide plate 520, the diffusing plate 530, and the LED board 510 may be provided as an integral structure.

Figure 11:
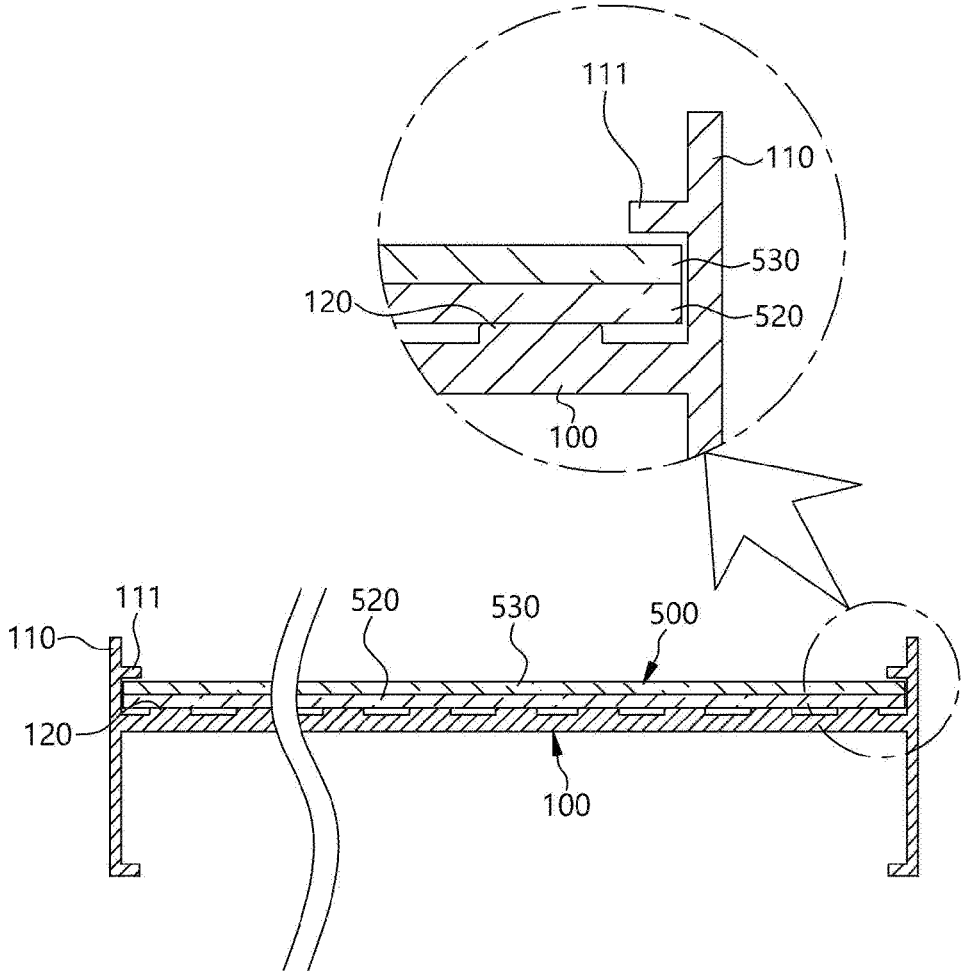
Figure 12:
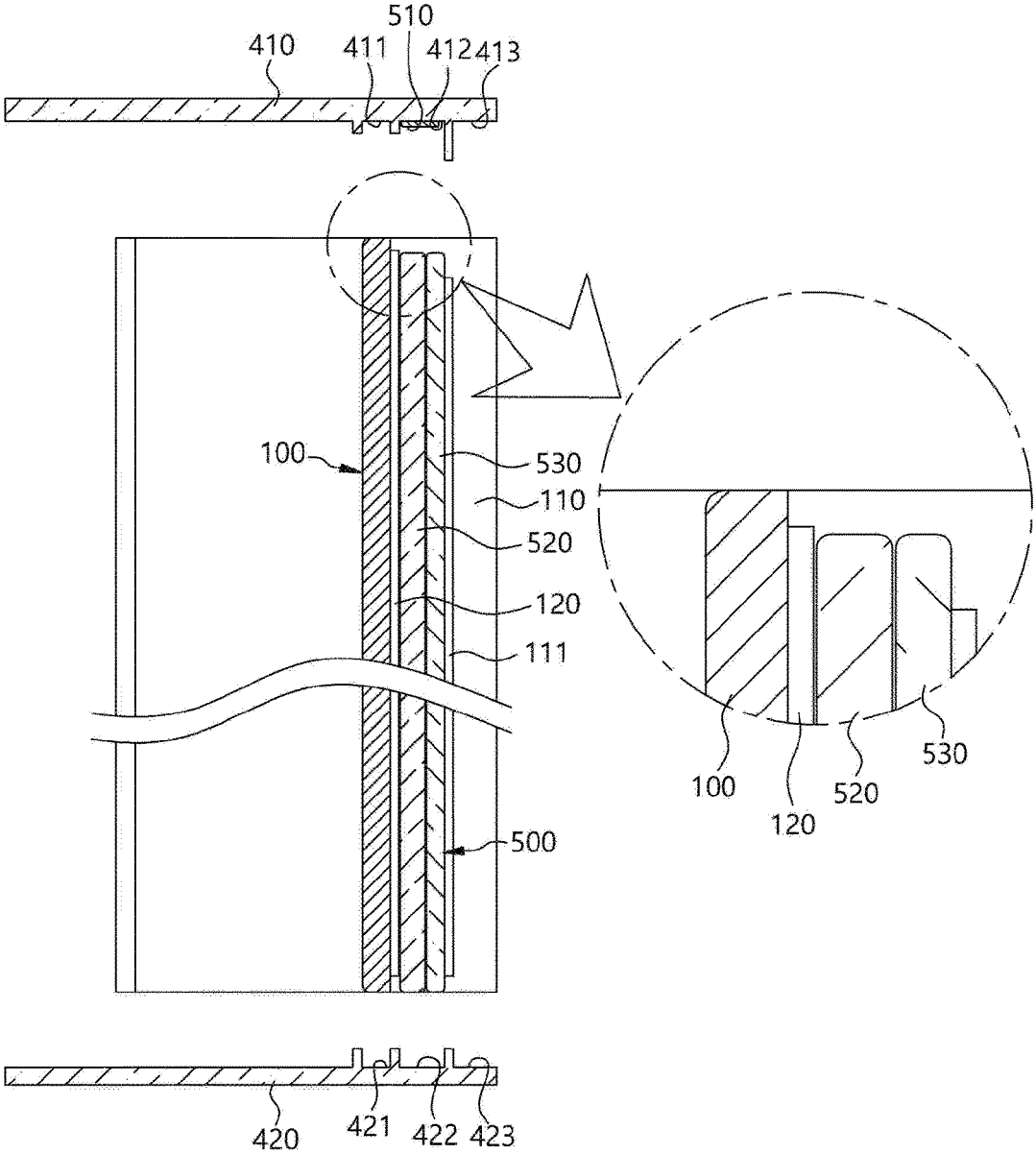

Furthermore, the prepared the light guide plate 520 and the diffusing plate 530 of the color module 500 may be inserted between the two protruding ends 110 formed on the door frame 100. Specifically, the light guide plate 520 and the diffusing plate 530 may be installed to be located between the front surface of the door frame 100 and the partitioning protrusions 111 formed on the protruding ends 110, respectively, and the diffusing plate 530 may be located on the front surface of the light guide plate 520. This is illustrated in FIGS. 11 and 12.

In this case, since the plurality of support parts 120 is formed on the front surface of the door frame 100, the light guide plate 520 and the diffusing plate 530 may be mounted to be flat without bending between the front surface of the door frame 100 and the partitioning protrusions 111.

In addition, in a state in which the light guide plate 520 and the diffusing plate 530 are completely mounted, the cover frames 410 and 420 may be coupled respectively to the upper and lower ends of each of the door frame 100 and the inner frame 200.

Figure 13:
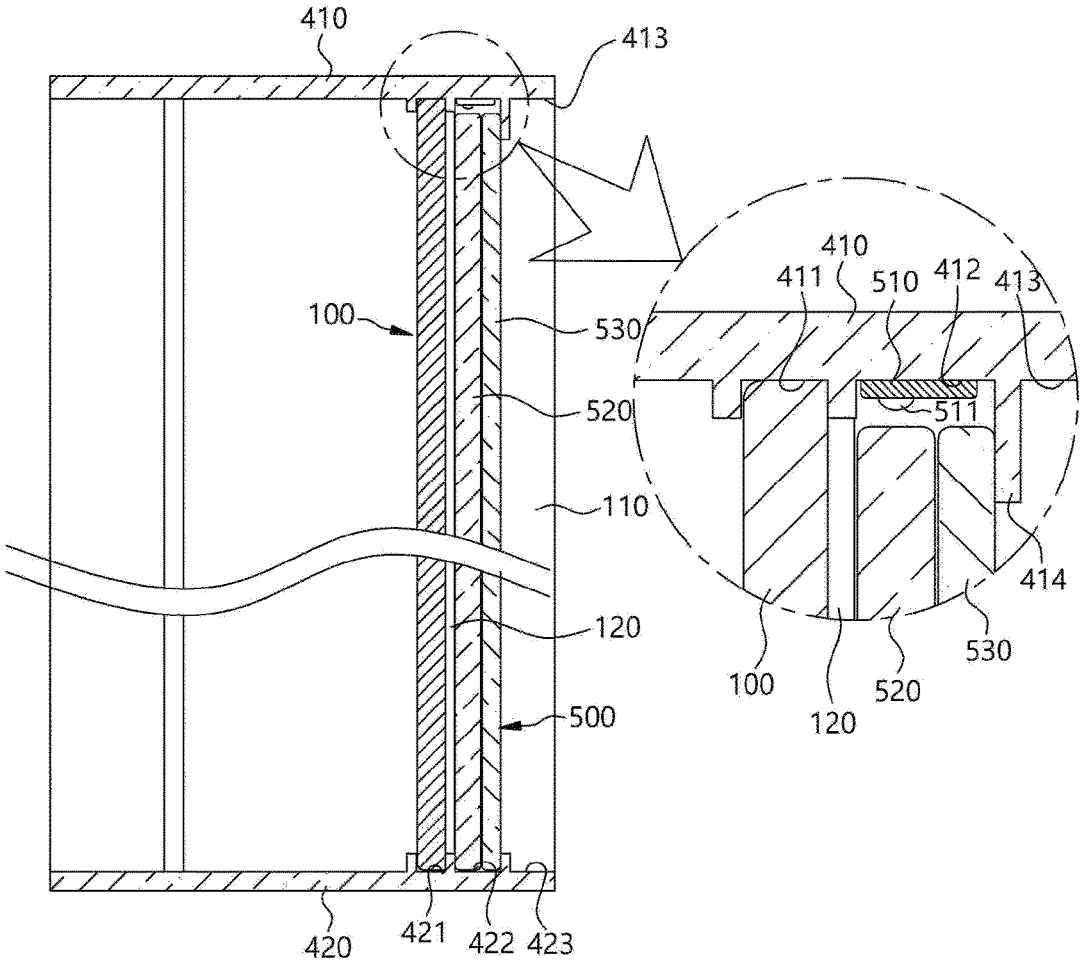

After the coupling of the cover frames 410 and 420, the door frame 100 may be inserted into and mounted to the first mounting grooves 411 and 421 formed in the cover frames 410 and 420, respectively, and the color module 500 may be inserted into and mounted to the second mounting grooves 412 and 422 formed in the cover frames 410 and 420, respectively. This is illustrated in FIGS. 12 and 13.

In this case, the LED board 510 may be located inside the second mounting groove 412 such that LED light is emitted toward the upper surface of the light guide plate 520.

The LED board 510 constituting the color module 500 may be installed to be located inside the second mounting grooves 412 and 422 in various methods.

For example, in a state in which the LED board 510 is prefixed (for example, attached) to the upper surface of the light guide plate 520, the coupling of the upper cover frame 410 may be performed such that the LED board 510 is located inside the second mounting groove 412.

Alternatively, in a state in which the cover frames 410 and 420 are coupled to the door frame 100 and the inner frame 200, the LED board 510 may pass through the side wall frame 620 such that the LED board 510 is located in the second mounting groove 412 formed in the upper cover frame 410.

Alternatively, in a state in which the LED board 510 is located in advance in the second mounting groove 412 formed in the upper cover frame 410, the upper cover frame 410 may be coupled to the door frame 100 and the inner frame 200.

In addition, in a state in which the color module 500 is installed between the door frame 100, the cover frames 410 and 420, and the side wall frames 620, the tempered glass 610 may be mounted to the front surface of the color module 500. This is illustrated in FIGS. 4 and 5.

The tempered glass 610 may be attached to the color module 500 by using the adhesive member 611. That is, the adhesive member 611 may be attached to the edge of the front surface of the diffusing plate 530 therealong and then the tempered glass 610 may be attached to the front surface of the diffusing plate. In a case in which the diffusing plate 530 is not provided, the tempered glass 610 may be attached to the front surface of the light guide plate 520.

Of course, the adhesive member 611 may be configured to be attached to each of the opposing surfaces of the front surface of the partitioning protrusion 111 and the tempered glass 610.

Furthermore, as described above, when the assembly of the door frame 100 with the color module 500 is completed, the inner frame 200 and the side wall frames 620 are prepared. In this case, the inner frame 200 and the side wall frames 620 described above may be manufactured and provided through manufacturing processes different from the manufacturing process of the door frame 100.

Additionally, the prepared the inner frame 200 may be disposed to be spaced apart in a front-to-rear direction from the door frame 100 and then the side wall frames 620 may be coupled to the opposite sides thereof, respectively.

Accordingly, the door frame 100 and the inner frame 200 may be maintained to be spaced apart by a predetermined distance from each other.

Furthermore, the insulation member 300 may be formed between the door frame 100 and the inner frame 200. The insulation member 300 may be formed by filling space between the door frame 100 and the inner frame 200 with foam (for example, PU foam). This is illustrated in FIGS. 4 and 5.

Accordingly, through the above-described process, the refrigerator door 10 according to the embodiment of the present disclosure may be completely manufactured.

Meanwhile, the color module 500 of the refrigerator door 10 may be connected to the controller of the refrigerator (not shown) such that the color module 500 is controlled by the controller.

For example, the connector 512 of the color module 500 and the controller may be connected to each other by a cable (a signal line) (not shown) such that the LED board 510 of the color module 500 is controlled by the controller, so the color module 500 may light the LED 511 in a specific color. Furthermore, the color module 500 may be controlled to be turned on/off and thus can display colors only when needed.

In addition, considering that the controller can be manipulated by a user, it is possible to change the color of the refrigerator to the same color as surrounding furniture or other devices.

In addition, it is possible to update information on realizable colors through a dedicated application while the controller is connected online.

As described above, the refrigerator door 10 of the present disclosure may be expressed in color desired by a user by using the multiple LEDs 511, and thus color of the refrigerator door may be easily changed.

Particularly, the refrigerator door 10 of the present disclosure may have color changed by being manipulated by a user. Accordingly, even without replacing the entirety of the refrigerator door 10 or the front surface of the refrigerator door 10, the refrigerator door 10 (or the front surface) may be expressed in color desired by a user.

In addition, a structure for the installation of the color module 500 may be installed to be integrated with the front surface of the refrigerator door 10 of the present disclosure, thereby preventing problems such as the inconvenience of assembly of the refrigerator door and the increase of the thickness of the refrigerator door due to an increased structure which are caused by providing the structure for installing the color module 500 separately from the refrigerator door 10.

In addition, in the refrigerator door 10 of the present disclosure, the LED board 510 may be located in the cover frames 410, and may be configured to be covered by the cover protrusion 414, so the light leakage may be prevented.

In addition, in the refrigerator door 10 of the present disclosure, the tempered glass 610 may be received in the glass receiving parts 413 and 423 and may be configured to be bonded to the partitioning protrusions 111 or the front surface of the color module 500, so the thickness of the refrigerator door 10 may be minimized and a work for the installation of the tempered glass 610 may be facilitated.

In addition, in the refrigerator door 10 of the present disclosure, the plurality of support parts 120 may be formed on the front surface of the door frame 100 to support the light guide plate 520, and thus the light guide plate 520 may have a precisely flat surface, so color defects due to the bending deformation of the light guide plate 520 may be prevented.

Meanwhile, the refrigerator door 10 of the present disclosure may be embodied in various forms other than a structure according to the above-described embodiment.

For example, although not shown, in the refrigerator door 10 of the present disclosure, the LED board 510 may be installed inside each of the protruding ends 110 of the door frame 100. That is, the LED board 510 may be located on any one side wall of the light guide plate 520 and may be configured as the light source.

In this case, the partitioning protrusion 111 formed on the protruding end 110 is preferably formed to have enough length to prevent the exposure of the LED board 510 and light leakage.

In addition, although not shown, the side wall frames 620 of the refrigerator door 10 of the present disclosure may be configured to cover the opposite wall surfaces of the door frame 100 from the opposite wall surfaces of the inner frame 200, or to cover the opposite wall surfaces of the inner frame 200 from the opposite wall surfaces of the door frame 100.

In addition, although not shown, in the refrigerator door 10 of the present disclosure, at least one of the inner frame 200 and the insulation member 300 may be omitted.

For example, an empty space may be defined between the door frame 100 and the inner frame 200.

Alternatively, the inner frame 200 and the door frame 100 may be configured to be integrated with each other.

In addition, although not described or shown in the embodiment, the refrigerator door 10 of the present disclosure may be embodied by including all the components (the door frame, the inner frame, the insulation member, the cover frames, and the color module) mentioned in the above-described embodiment, or may be embodied by including only some components.

Accordingly, the refrigerator door of the present disclosure may be embodied in various forms.

What is claimed is:

1. A refrigerator door comprising:

a door frame having first and second protruding ends formed on a front surface of the door frame;

an upper cover frame to cover an upper end of the door frame;

a lower cover frame to cover a lower end of the door frame;

a color module mounted between the first protruding end of the door frame and the second protruding end of the door frame, and the color module including a plurality of light emitting devices, and configured to display a color by using the plurality of LEDs, a first partition protrusion that protrudes from an inner surface of the first protruding end, and a second partitioning protrusion that protrudes from an inner surface of the second protruding end, the first and second partitioning protrusions respectively covering opposite edges of a front surface of the color module.

2. The refrigerator door of claim 1, wherein a support is disposed on the front surface of the door frame and configured to support the color module.

3. The refrigerator door of claim 2, wherein the support includes a plurality of supports disposed on the front surface of the door frame, and the plurality of supports are spaced apart from each other in a longitudinal direction of the door frame.

4. The refrigerator door of claim 2, wherein the support protrudes forward from the front surface.

5. The refrigerator door of claim 1, comprising a tempered glass provided between the first protruding end and the second protruding end, and the tempered glass disposed on a front of the color module.

6. The refrigerator door of claim 5, wherein the first and second partitioning protrusions are located between the tempered glass and the color module.

7. The refrigerator door of claim 5, wherein the tempered glass is attached to the front of the color module by an adhesive member.

8. The refrigerator door of claim 7, wherein the adhesive member is provided on an edge of the tempered glass or the color module.

9. The refrigerator door of claim 1, wherein an upper first mounting groove is disposed on an inner surface of the upper cover frame and a lower first mounting groove is disposed on an inner surface of the lower cover frame, the upper first mounting groove to receive the upper end of the door frame, and the lower first mounting groove to receive the lower end of the door frame.

10. The refrigerator door of claim 9, wherein an upper second mounting groove is disposed on an inner surface of the upper cover frame and a lower second mounting groove is disposed on an inner surface of the lower cover frame, the upper second mounting groove to receive the upper end of the color module, and the lower second mounting groove to receive the lower end of the color module.

11. The refrigerator door of claim 10, wherein a glass receiving part is formed on the upper cover frame at an area of the inner surface of the upper cover frame that is more forward than the upper second mounting groove, and a glass receiving part is formed on the lower cover frame at an area of the inner surface of the lower cover frame that is more forward than the lower second mounting groove, wherein a tempered glass is received in the glass receiving parts.

12. The refrigerator door of claim 1, wherein the color module comprises:

a light guide plate, and an LED board disposed at a periphery of the light guide plate, the LED board is configured to support the plurality of LEDs.

13. The refrigerator door of claim 12, wherein the LED board is received in the upper cover frame or the lower cover frame, and a cover protrusion is to protrude from the one of the upper cover frame or the lower cover frame, the cover protrusion configured to prevent the LED board from being exposed to a front of the refrigerator door.

14. The refrigerator door of claim 12, wherein the LED board is received in one of the first protruding end of the door frame and the second protruding end of the door frame, and a partitioning protrusion is to protrude from the one of the first protruding end and the second protruding end, the partitioning protrusion configured to cover a portion of a front surface of the color module.

15. The refrigerator door of claim 12, wherein a connector is provided on one side of the LED board.

16. A refrigerator door comprising:

a door frame constituting an outer body of the refrigerator door and having first and second protruding ends that protrude from a front surface of the door frame;

an inner frame constituting an inner body of the refrigerator door, and the inner frame is spaced apart from a rear surface of the door frame;

an upper cover frame to cover an upper end of each of the door frame and the inner frame, and a lower cover frame to cover a lower end of each of the door frame and the inner frame; and a color module mounted between the first and second protruding ends of the door frame, the color module configured to display a color by using a plurality of LEDs.

17. The refrigerator door of claim 16, wherein the door frame is spaced apart from the inner frame.

18. The refrigerator door of claim 16, comprising an insulation member between the door frame and the inner frame.

19. A refrigerator door comprising:

a door frame having first and second protruding ends formed on a front of the door frame;

an upper cover frame to cover an upper end of the door frame;

a lower cover to cover a lower end of the door frame; and a color device mounted between the first protruding end of the door frame and the second protruding end of the door frame, and the color device including a light guide plate and a substrate having a plurality of light emitting devices, and configured to display a color by using the plurality of LEDs; and a glass provided between the first protruding end and the second protruding end, and the glass disposed on a front of the color module;

an upper first mounting groove on an inner surface of the upper cover frame, the upper first mounting groove to receive the upper end of the door frame; and an upper second mounting groove on the inner surface of the upper cover frame, the upper second mounting groove to receive the upper end of the color module, wherein a glass receiving part is formed on the upper cover frame at an area of the inner surface of the upper cover frame that is more forward than the upper second mounting groove, and a glass receiving part is formed on the lower cover frame at an area of the inner surface of the lower cover frame that is more forward than the lower second mounting groove, and wherein a tempered glass is received in the glass receiving parts.

* * * * *